US008390215B2

(12) United States Patent
Tseng

(10) Patent No.: US 8,390,215 B2
(45) Date of Patent: Mar. 5, 2013

(54) LIGHT EMITTING DIODE CIRCUIT, LIGHT EMITTING DIODE DRIVING CIRCUIT, VOLTAGE SELECTION CIRCUIT, AND METHOD FOR DRIVING THEREOF

(75) Inventor: Kuan-Jen Tseng, Fonghua Village (TW)

(73) Assignee: Himax Analogic, Inc., Tainan County (TW)

( * ) Notice: Subject to any disclaimer, the term of this patent is extended or adjusted under 35 U.S.C. 154(b) by 236 days.

(21) Appl. No.: 12/899,825

(22) Filed: Oct. 7, 2010

(65) Prior Publication Data

US 2012/0086357 A1 Apr. 12, 2012

(51) Int. Cl.
*H05B 37/02* (2006.01)

(52) U.S. Cl. ..... 315/294; 315/185 R; 315/312

(58) Field of Classification Search ..... 315/185 R, 315/186, 192, 247, 291, 294, 307, 308, 312, 315/324, 360

See application file for complete search history.

(56) References Cited

U.S. PATENT DOCUMENTS

2007/0188426 A1* 8/2007 Ito et al. ..... 345/82
2007/0296353 A1* 12/2007 Ito et al. ..... 315/307
2008/0018266 A1* 1/2008 Yu et al. ..... 315/291
2010/0109563 A1* 5/2010 Gong et al. ..... 315/294
2010/0148679 A1* 6/2010 Chen et al. ..... 315/185 R
2010/0264837 A1* 10/2010 Zhao ..... 315/189
2010/0328370 A1* 12/2010 Takata et al. ..... 345/694
2011/0018451 A1* 1/2011 Kotikalapoodi et al. . 315/185 R

* cited by examiner

*Primary Examiner* — Tung X Le
(74) *Attorney, Agent, or Firm* — McClure, Qualey & Rodack, LLP

(57) ABSTRACT

A voltage selection circuit selecting a minimum voltage from the remainder voltages outputted from the light emitting diode channels is disclosed. The voltage selection circuit includes a first picking circuit, which has the first operation amplifiers, a positive input terminal, an output terminal, a negative input terminal, and an output stage. Each of the first operation amplifiers includes a positive input terminal, an output terminal, a negative input terminal, and an output stage. The positive input terminal receives one of the remainder voltages from one of the first ends of the light emitting diode channels. The output terminal outputs the minimum voltage, in which the output terminals of the first operation amplifiers are connected together. The negative input terminal is electrically connected to the output terminal. The output stage is electrically connected to the output terminal, in which the output stage has current sinking ability stronger than current sourcing ability.

12 Claims, 4 Drawing Sheets

LIGHT EMITTING DIODE CIRCUIT, LIGHT EMITTING DIODE DRIVING CIRCUIT, VOLTAGE SELECTION CIRCUIT, AND METHOD FOR DRIVING THEREOF

BACKGROUND

1. Field of Invention

This disclosure relates to a light emitting diode circuit. More particularly, the present invention relates to a white light emitting diode circuit.

2. Description of Related Art

The light emitting diodes (LEDs) are estimated to be four times as efficient as conventional incandescent lights. They are also claimed to be more economically sound than compact fluorescent bulbs that contain harmful mercury and are supposed to last a lot longer than conventional lighting. Therefore, LEDs may become the mainstream of the lighting technology.

Feedback voltage is often used to determine the appropriate voltage or current supplied to the LED channels. Usually, the feedback voltage is from the minimal output voltage of the LED channels, which stands for the critical condition of the LED channels. The module providing the driving voltage/current receives the minimal output voltage as the feedback voltage to determine the operation status of the LED channels and further appropriately adjusts the driving voltage/current supplied to the LED channels.

However, it is hard to detect the minimal output voltage of the LED channels because every channel has different voltage drops across the LED strings. It is even more difficult to select the minimal output voltage from the LED channels as the feedback voltage if there are several LED channels disposed in parallel. Accordingly, a new circuit and a new method are required to correctly choose the minimal output voltage from the LED channels as the feedback voltage when there are several LED channels disposed in parallel.

SUMMARY

According to one embodiment of the present invention, a voltage selection circuit for selecting a minimum voltage from the remainder voltages outputted from first ends of a plurality of light emitting diode channels is disclosed. The voltage selection circuit includes a first picking circuit which includes a plurality of first operation amplifiers. Each of the first operation amplifiers has: a positive input terminal receiving one of the remainder voltages from one of the first ends of the light emitting diode channels; an output terminal for outputting the minimum voltage, in which the output terminals of the first operation amplifiers are connected together; a negative input terminal electrically connected to the output terminal; and an output stage electrically connected to the output terminal, in which the output stage has the current sinking ability stronger than the current sourcing ability.

According to another embodiment of the present invention, a light emitting diode driving circuit for driving a plurality of light emitting diode channels is disclosed. The light emitting diode driving circuit includes a voltage selection circuit for selecting a minimum voltage from a plurality of remainder voltages outputted from first ends of a plurality of light emitting diode channels, and the voltage selection circuit includes a first picking circuit which has a plurality of first operation amplifiers. The light emitting diode driving circuit also includes a boost circuit for generating a PWM signal having a duty cycle according to the selected out minimum voltage; and a DC-to-DC voltage converter for generating a driving voltage on the second ends of the light emitting diode channels according to the PWM signal.

Each of the first operation amplifiers includes a positive input terminal receiving one of the remainder voltages from one of the first ends of the light emitting diode channels; an output terminal for outputting the minimum voltage, in which the output terminals of the first operation amplifiers are connected together; a negative input terminal electrically connected to the output terminal; and an output stage electrically connected to the output terminal, in which the output stage has the current sinking ability stronger than the current sourcing ability.

According to still another embodiment of the present invention, a light emitting diode circuit including a plurality of light emitting diode channels and a light emitting diode driving circuit for driving the light emitting diode channels is disclosed. The light emitting diode driving circuit includes a voltage selection circuit for selecting a minimum voltage from a plurality of remainder voltages outputted from first ends of a plurality of light emitting diode channels, and the voltage selection circuit includes a first picking circuit which has a plurality of first operation amplifiers. The light emitting diode driving circuit also includes a boost circuit for generating a PWM signal having a duty cycle according to the selected out minimum voltage; and a DC-to-DC voltage converter for generating a driving voltage on the second ends of the light emitting diode channels according to the PWM signal.

Each of the first operation amplifiers includes a positive input terminal receiving one of the remainder voltages from one of the first ends of the light emitting diode channels; an output terminal for outputting the minimum voltage, in which the output terminals of the first operation amplifiers are connected together; a negative input terminal electrically connected to the output terminal; and an output stage electrically connected to the output terminal, in which the output stage has current sinking ability stronger than current sourcing ability According to the other embodiment of the present invention, a method for driving a plurality of light emitting diode channels is disclosed. The method selects a minimum voltage from a plurality of remainder voltages outputted from first ends of a plurality of light emitting diode channels with a plurality of first operation amplifiers having their output terminals connected together; generates a PWM signal having a duty cycle according to the selected out minimum voltage; and generates a driving voltage on second ends of the light emitting diode channels according to the PWM signal.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
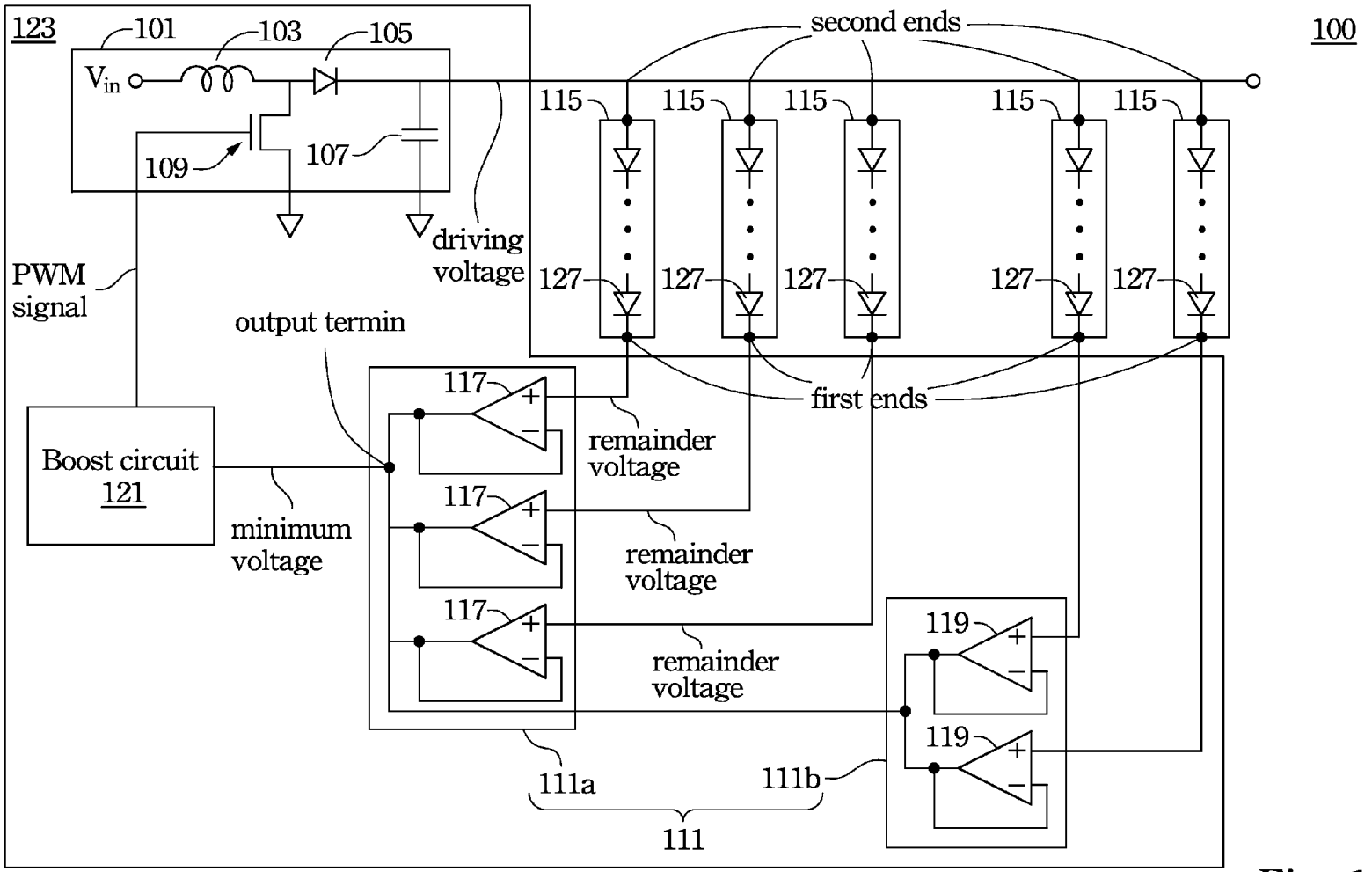
FIG. 1 shows the circuit diagram of the light emitting diode circuit according to one embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The light emitting diode (LED) circuit, the LED driving circuit, and the voltage selection circuit of the following embodiment can detect the remainder voltages on several light emitting diode channels after some voltage drop has been exhausted on the LEDs, and the minimum voltage among those remainder voltages can be selected by the voltage selection circuit and feedback to the driving circuit, such that the driving voltage driving the LED channels can be more precise.

FIG. 1 shows the circuit diagram of the light emitting diode circuit according to one embodiment of the present invention. The light emitting diode circuit 100 includes several light emitting diode channels 115 composed of serial connected white light emitting diodes 127. Each light emitting diode 127 causes some voltage drop, which makes the remainder voltages on the first ends of the light emitting diode channel 115 different from the driving voltage on the second ends.

Except the light emitting diode channels 115, the light emitting diode circuit 100 also includes a light emitting diode driving circuit 123 for driving the light emitting diode channel 115, in which the light emitting diode driving circuit 123 includes a voltage selection circuit 111, a boost circuit 121, and a DC-to-DC voltage converter 101.

The voltage selection circuit 111 selects the minimum voltage from the remainder voltages outputted from first ends of the light emitting diode channel 115; the boost circuit 121 generates the PWM signal having a duty cycle according to the selected out minimum voltage, in which the boost circuit 121 might employ several current sink circuits (not shown) positioned to control the flows of current flowing through the light emitting diode channel 115. After the PWM signal has been generated according to the selected minimum voltage, the DC-to-DC voltage converter 101 generates the driving voltage on first ends of the light emitting diode channel 115 according to the PWM signal.

The DC-to-DC voltage converter 101 including the switch 109, the inductor 103, the diode 105, and the capacitor 107 generates the driving voltage on second ends of the light emitting diode channel 115, and the magnitude of the driving voltage is correlated with the conduction time of the switch 109. For example, if the minimum voltage selected by the voltage selection circuit 111 decreases, the boost circuit 121 will increase the conduction time of the switch 109 in order to increase the driving voltage driving the light emitting diode channel 115.

In more detail, the voltage selection circuit 111 includes the first picking circuit 111*a*, which has several first operation amplifiers 117, and each of the first operation amplifiers 117 has a positive input terminal (+), a negative input terminal (−), and an output terminal. The positive input terminal receives one of the remainder voltages from one of the first ends of the light emitting diode channel 115. The output terminals of all the first operation amplifier 117 are connected together for outputting the minimum voltage, and the negative input terminal is electrically connected to the output terminal. Because the output terminals of all the first operation amplifiers 117 are connected together, the minimum voltage on the output terminals are decided by the first operation amplifier 117 which has the strongest current sinking ability due to the circuit physical characteristic.

To drive more light emitting diode channel 115, the voltage selection circuit 111 may further include the second picking circuit 111*b*, which includes several second operation amplifiers 119 having their positive input terminals (+) receiving the remainder voltages from the light emitting diode channel 115 and having their output terminals connected to the output terminals of the first operation amplifiers 117. By connecting all the output terminals together, the operation amplifier 117/119 which receives the minimum remainder voltage has the strongest current sinking ability and automatically dominates the minimum voltage.

Figure 2:
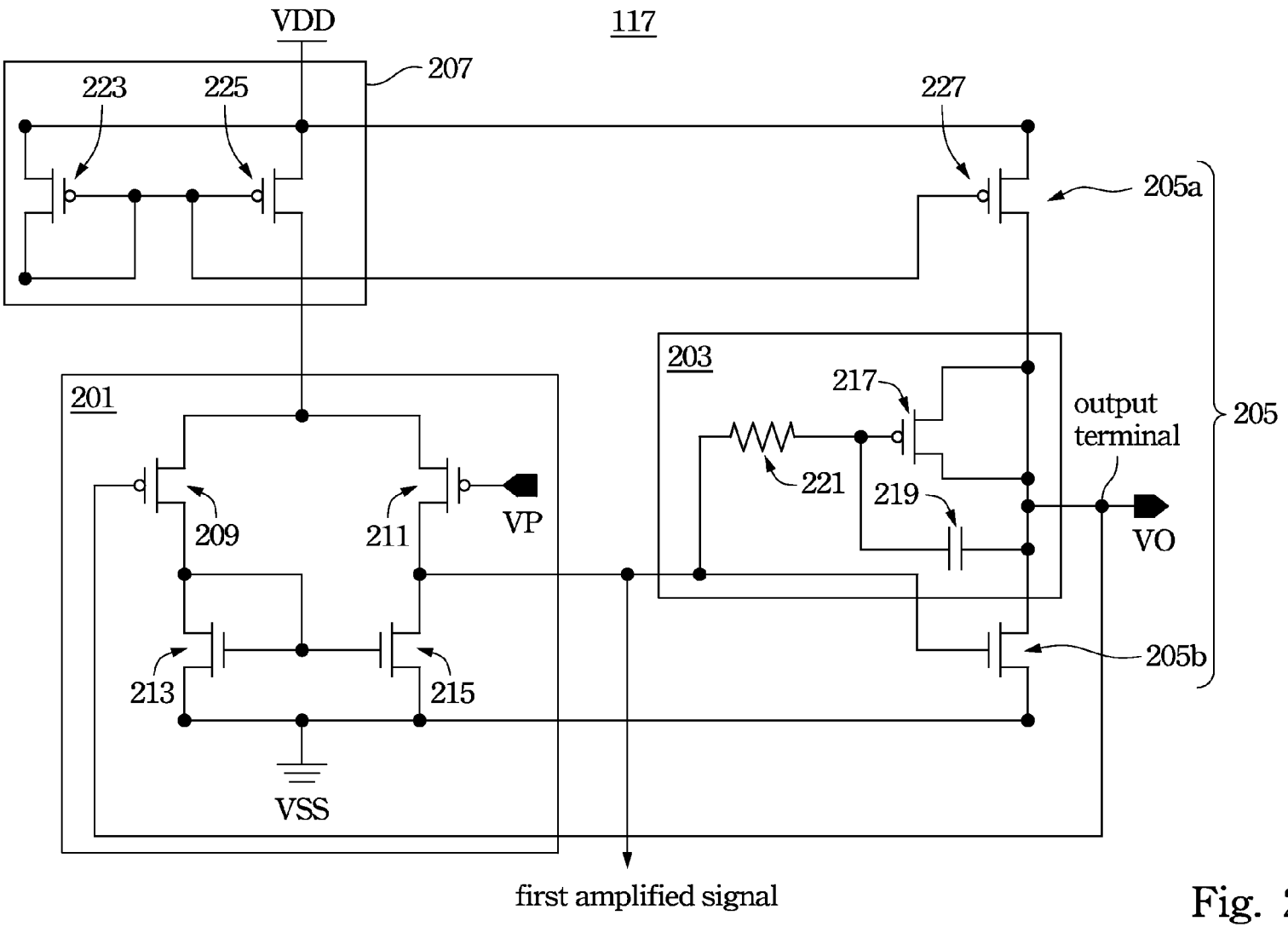
FIG. 2 shows the circuit diagram of the first operation amplifier according to one embodiment of the present invention.

FIG. 2 shows the circuit diagram of the first operation amplifier according to one embodiment of the present invention. The first operation amplifier 117 includes the output stage 205 electrically connected to the output terminal, in which the output stage 205 has current sinking ability stronger than the current sourcing ability. In more detail, the output stage 205 of the first operation amplifier 117 includes the source transistor 205*a* and the sink transistor 205*b* electrically connected to the output terminal of the first operation amplifier 117, and the current sinking ability of the sink transistor 205*b* is stronger than the current sourcing ability of the source transistor 205*a*, such that the minimal voltage is determined by the sink transistor 205*b*.

The first operation amplifier 117 further includes the differential amplifier 201 and the second stage amplifier 203. The differential amplifier 201 having the transistor 209/211/213/125 configured as FIG. 2 receives and differentially amplifies the remainder voltage to generate a first amplified signal. The second stage amplifier 203 having the transistor 217, the resistor 221, and the capacitor 219 configured as FIG. 2 further amplifies the first amplified signal to be the minimum voltage outputted by the output terminal. The current mirror 207 having the transistors 223/225 provides the constant current for the differential amplifier 201.

Figure 3:
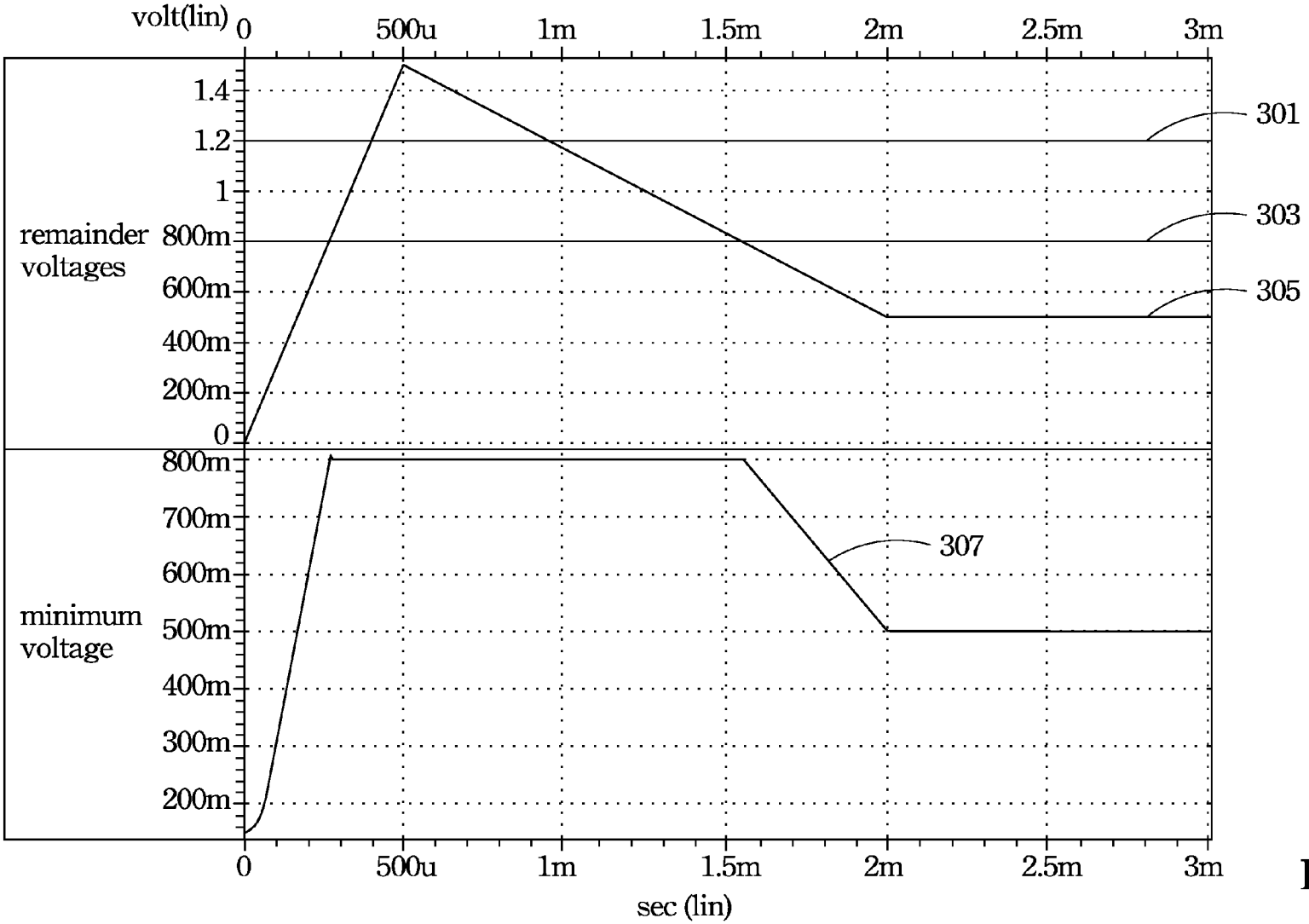
FIG. 3 shows the waveforms of the remainder voltages from the LED channel and the selected out minimum voltage according to one embodiment of the present invention.

FIG. 3 shows the waveforms of the remainder voltages from the LED channel and the selected out minimum voltage according to one embodiment of the present invention. As shown in FIG. 3, the remainder voltage 301 is constantly 1.2 volt, the remainder voltage 303 is constantly 0.8 volt, while the remainder voltage 305 varies with time. The minimum voltage 307 selected by the voltage selection circuit is the minimum among the remainder voltage 301, the remainder voltage 303 and the remainder voltage 305.

Figure 4:
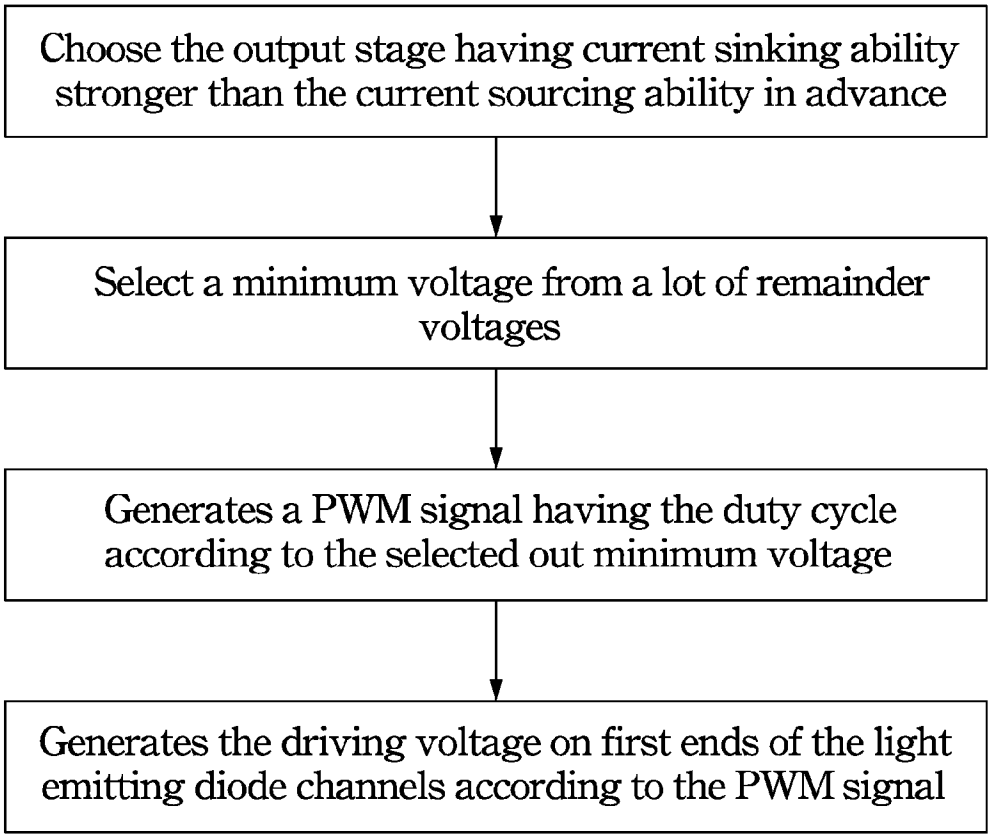
FIG. 4 shows the flowchart of the method for driving several light emitting diode channels according to one embodiment of the present invention.

FIG. 4 shows the flowchart of the method for driving several light emitting diode channels according to one embodiment of the present invention. The method first selects a minimum voltage from a lot of remainder voltages outputted from first ends of several light emitting diode channels with the first operation amplifiers having their output terminals connected together; the method then generates a PWM signal having the duty cycle according to the selected out minimum voltage and generates the driving voltage on second ends of the light emitting diode channels according to the PWM signal. Specifically, the method chooses the output stage of the first operation amplifiers having current sinking ability stronger than the current sourcing ability in advance.

According to the above embodiments, the light emitting diode (LED) circuit, the LED driving circuit, and the voltage selection circuit can detect the remainder voltages on several light emitting diode channels after some voltage drop has been exhausted by the LEDs, and the minimum voltage among those remainder voltages can be selected by the voltage selection circuit and feedback to the driving circuit, such that the driving voltage driving the LED channels can be more precisely.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage selection circuit for selecting a minimum voltage from a plurality of remainder voltages outputted from first ends of a plurality of light emitting diode channels, the voltage selection circuit comprising a first picking circuit, which comprises:

a plurality of first operation amplifiers, each of which comprises:

a positive input terminal receiving one of the remainder voltages from one of the first ends of the light emitting diode channels;

an output terminal for outputting the minimum voltage, wherein the output terminals of the first operation amplifiers are connected together;

a negative input terminal electrically connected to the output terminal; and an output stage electrically connected to the output terminal, wherein the output stage has current sinking value larger than current sourcing value.

2. The voltage selection circuit as claimed in claim 1, wherein the output stage of the first operation amplifier comprises a source transistor and a sink transistor electrically connected to the output terminal of the first operation amplifier, and the current sinking value of the sink transistor is larger than the current sourcing value of the source transistor, such that the minimal voltage is determined by the sink transistor.

3. The voltage selection circuit as claimed in claim 2, wherein each of the first operation amplifiers further comprises:

a differential amplifier for receiving and differentially amplifying the remainder voltage to generate a first amplified signal; and a second stage amplifier for further amplifying the first amplified signal to be the minimum voltage outputted by the output terminal.

4. The voltage selection circuit as claimed in claim 1, further comprising a second picking circuit which includes a plurality of second operation amplifiers having their positive input terminals receiving the remainder voltages from the light emitting diode channels and having their output terminals connected to the output terminals of the first operation amplifiers.

5. A light emitting diode driving circuit for driving a plurality of light emitting diode channels, comprising:

voltage selection circuit for selecting a minimum voltage from a plurality of remainder voltages outputted from first ends of a plurality of light emitting diode channels, the voltage selection circuit comprising a first picking circuit which comprises a plurality of first operation amplifiers, and each of the first operation amplifiers comprises:

a positive input terminal receiving one of the remainder voltages from one of the first ends of the light emitting diode channels;

an output terminal for outputting the minimum voltage, wherein the output terminals of the first operation amplifiers are connected together;

a negative input terminal electrically connected to the output terminal; and an output stage electrically connected to the output terminal, wherein the output stage has current sinking value larger than current sourcing valueability;

a boost circuit for generating a PWM signal having a duty cycle according to the selected out minimum voltage; and a DC-to-DC voltage converter for generating a driving voltage on second ends of the light emitting diode channels according to the PWM signal.

6. The light emitting diode driving circuit as claimed in claim 5, wherein the output stage of the first operation amplifier comprises a source transistor and a sink transistor electrically connected to the output terminal of the first operation amplifier, and the current sinking value of the sink transistor is larger than the current sourcing valueability of the source transistor, such that the minimal voltage is determined by the sink transistor.

7. The light emitting diode driving circuit as claimed in claim 5, wherein each of the first operation amplifiers further comprises:

a differential amplifier for receiving and differentially amplifying the remainder voltage to generate a first amplified signal; and a second stage amplifier for further amplifying the first amplified signal to be the minimum voltage outputted by the output terminal.

8. The light emitting diode driving circuit as claimed in claim 5, further comprising a second picking circuit which includes a plurality of second operation amplifiers having their positive input terminals receiving the remainder voltages from the light emitting channels and having their output terminals connected to the output terminals of the first operation amplifiers.

9. A light emitting diode circuit, comprising:

a plurality of light emitting diode channels; and a light emitting diode driving circuit for driving the light emitting diode channels, the light emitting diode driving circuit comprising:

a voltage selection circuit for selecting a minimum voltage from a plurality of remainder voltages outputted from first ends of a plurality of light emitting diode channels, the voltage selection circuit comprising a first picking circuit which comprises a plurality of first operation amplifiers, and each of the first operation amplifiers comprises:

a positive input terminal for receiving one of the remainder voltages from one of the first ends of the light emitting diode channels;

an output terminal connected together for outputting the minimum voltage;

a negative input terminal electrically connected to the output terminal; and an output stage electrically connected to the output terminal, wherein the output stage has current sinking value larger than current sourcing value;

a boost circuit for generating a PWM signal having a duty cycle according to the selected out minimum voltage; and a DC-to-DC voltage converter for generating a driving voltage on second ends of the light emitting diode channels according to the PWM signal.

10. The light emitting diode circuit as claimed in claim 9, further comprising a second picking circuit which includes a plurality of second operation amplifiers having their positive input terminals receiving the remainder voltages from the light emitting channels and having their output terminals connected to the output terminals of the first operation amplifiers.

11. The light emitting diode circuit as claimed in claim 9, wherein each of the first operation amplifiers further comprises:

a differential amplifier for receiving and differentially amplifying the remainder voltage to generate a first amplified signal; and a second stage amplifier for further amplifying the first amplified signal to be the minimum voltage outputted by the output terminal.

12. A method for driving a plurality of light emitting diode channels, the method comprising:

choosing an output stage of the first operation amplifiers, wherein the output stage has current sinking ability stronger than current sourcing ability;

selecting a minimum voltage from a plurality of remainder voltages outputted from first ends of the plurality of light emitting diode channels with a plurality of first operation amplifiers having their output terminals connected together;

generating a PWM signal having a duty cycle according to the selected out minimum voltage; and generating a driving voltage on second ends of the light emitting diode channels according to the PWM signal.

* * * * *